US005937601A

United States Patent [19]

McDonald

[11] Patent Number: 5,937,601

[45] Date of Patent: Aug. 17, 1999

[54] SIMULATED BRICK CHIMNEY BLOCK

[76] Inventor: Robert L. McDonald, 3020 7th St. Detroit Beach, Monroe, Mich. 48161

[21] Appl. No.: 08/976,113

[22] Filed: Nov. 21, 1997

Related U.S. Application Data

[63] Continuation-in-part of application No. 08/708,233, Sep. 6, 1996, abandoned.

[51] Int. Cl.[6] ..... B44F 7/00

[52] U.S. Cl. ..... 52/314; 52/316; 52/218; 52/302.4; 232/39

[58] Field of Search ..... 52/314, 218, 606, 52/607, 315, 316, 219, 284, 286, 293.2, 289, 301, 302.4, 438; 232/17, 38, 39

[56] References Cited

U.S. PATENT DOCUMENTS

| | | | |
|---|---|---|---|
| 788,391 | 4/1905 | Bovee . | |
| 969,435 | 9/1910 | Adamson . | |
| 1,147,704 | 7/1915 | Bruckner . | |
| 1,193,484 | 8/1916 | Ellert . | |
| 1,795,862 | 3/1931 | Johnson . | |
| 2,178,535 | 10/1939 | Wilson . | |
| 2,629,135 | 2/1953 | Johnson . | |
| 3,177,279 | 4/1965 | Bilodeau | 52/314 X |
| 3,281,997 | 11/1966 | Leonard | 52/314 X |
| 3,307,822 | 3/1967 | Stout . | |
| 3,882,218 | 5/1975 | Bixel, Jr. | 52/314 X |
| 4,080,767 | 3/1978 | Wilhelm . | |
| 4,168,140 | 9/1979 | Fontana et al. . | |
| 4,407,480 | 10/1983 | Trimmer et al. . | |
| 4,422,269 | 12/1983 | Giard . | |
| 4,665,673 | 5/1987 | Diana . | |
| 4,811,534 | 3/1989 | Newsome . | |
| 4,875,622 | 10/1989 | Lents . | |
| 5,173,337 | 12/1992 | Nelson . | |
| 5,361,977 | 11/1994 | Ogrodnick . | |
| 5,386,963 | 2/1995 | Nasvik et al. . | |
| 5,487,526 | 1/1996 | Hupp . | |

*Primary Examiner*—Lanna Mai
*Attorney, Agent, or Firm*—Harness, Dickey & Pierce, P.L.C.

[57] ABSTRACT

A chimney is constructed from a plurality of precast chimney blocks. Each of the chimney blocks is of unitary construction and contains one or more decorative surfaces having the appearance of a simulated brick or stone pattern. The chimney blocks are made of a hardenable construction material that is poured into a mold containing a plurality of cavities and projections which form the decorative pattern that is projected onto the surfaces of the formed chimney block. The chimney blocks are stackable so that they may be used to construct chimneys of varying heights. Multiple chimney blocks are stacked upon one another and secured together using mortar or other material capable of holding the blocks firmly in place.

6 Claims, 4 Drawing Sheets

SIMULATED BRICK CHIMNEY BLOCK

This application is a Continuation-in-Part of U.S. patent application Ser. No. 08/708,233, filed Sep. 6, 1996, now abandoned.

BACKGROUND OF THE INVENTION

1. Field of the Invention

The present invention relates generally to chimney structures, and in particular to chimneys constructed from stackable chimney blocks made of a hardenable construction material, such as concrete, containing decorative patterns on their exterior surfaces to simulate brick or stone patterns.

2. Background Information

Chimneys are generally constructed in two ways. The first technique, a traditional method, is bricklaying. Individual units such as bricks or stones are laid to form the desired shape of the chimney, which is generally rectangular. Gaps between each unit are filled with a bonding substance such as mortar to hold together the chimney. This technique produces a brick chimney with a pleasing appearance, yet there are many problems associated with this technique including: high cost, lengthy construction time, and difficulty in properly forming the chimney.

The desire to create a more economical design led to a second technique: constructing chimneys from a single concrete or cinder block. In this method, concrete is poured into a mold to form a rectangular ring shaped chimney block. This one piece design is both cost efficient and easy to assemble, but it fails to significantly improve the traditional bricklaying technique due to problems with the design. The main problem is that the concrete block has a plain grey exterior that is generally undesirable. The concrete block's drab appearance leads people to forego the economic design for a traditionally-made chimney with a pleasing brick appearance.

Thus, there is a need to produce a chimney that is economical to construct and that has the pleasing appearance of traditional brick pattern chimneys.

SUMMARY OF THE INVENTION

It is an object of the present invention to construct a precast chimney block made of a single concrete piece containing one or more decorative surfaces with a simulated brick or stone pattern.

It is a further object of the present invention to produce a cost efficient patterned chimney block which is easy to assemble.

It is a further object of the present invention to produce a chimney block colored to a desired shade, such as brick red, at the time of manufacture.

It is yet another object of the present invention to form a chimney of uniform appearance by stacking the chimney blocks and securing them together.

The objects of the present invention are achieved by the chimney block of the present invention constructed of a single concrete piece containing one or more decorative exterior surfaces having a simulated brick or stone pattern. The chimney block is comprised of one or more side walls formed continuously into a chimney shape, which is generally a rectangular ring. The chimney block's top and bottom are open, and its center is hollow to allow a standard sized flue liner to be installed therein.

The chimney block is made of a hardenable construction material, such as concrete, plastic, or clay, which may be colored to a desired shade before forming the chimney block. The chimney block is made from a mold containing a plurality of cavities and projections which form the decorative pattern that is projected onto one or more exterior surfaces of the chimney block. The chimney block may be used to construct chimneys or other apparatuses, as shown by the preferred embodiment described in the detailed description below.

Additional objects, benefits and advantages of the present invention will become apparent from studying the subsequent drawings of the preferred embodiment and the appended claims, taken in conjunction with the accompanying drawings.

DETAILED DESCRIPTION OF THE PREFERRED EMBODIMENT

Preferred embodiments of a chimney structure comprising simulated brick chimney blocks are described here below with reference to the drawings.

Figure 1:
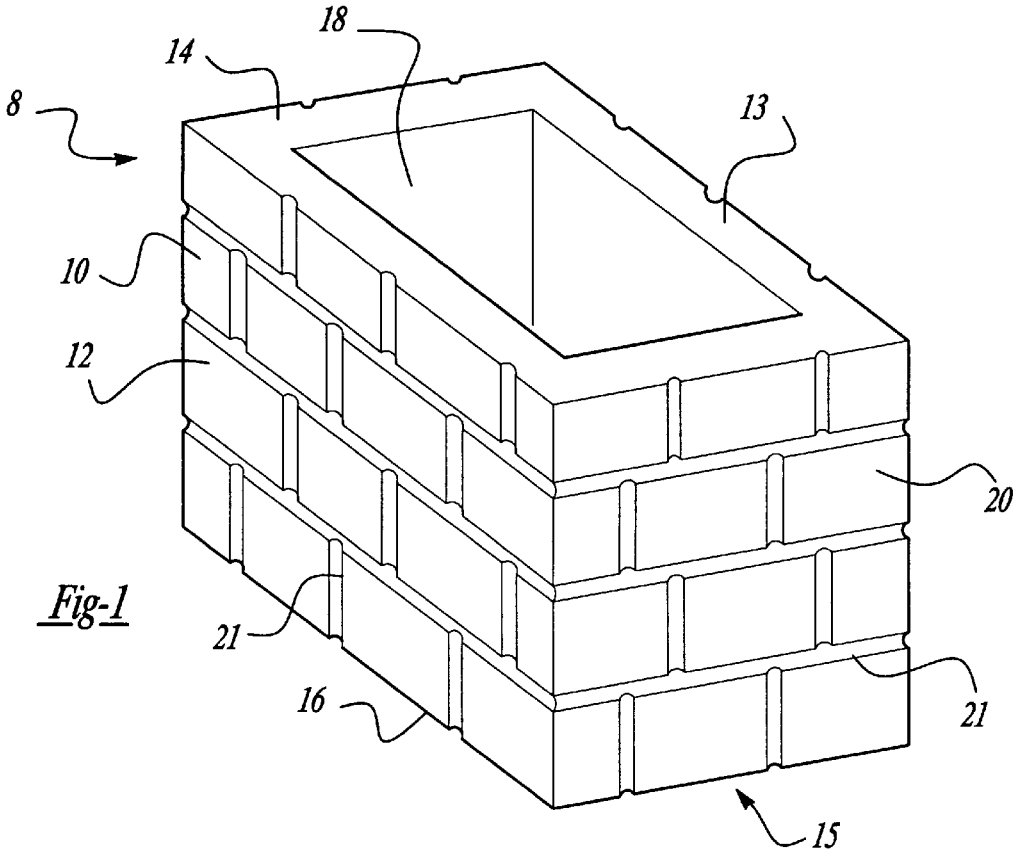
FIG. 1 is a perspective view of the chimney block of the present invention containing a simulated brick pattern on its side walls.

A chimney block 8 of the present invention is shown in FIG. 1. Chimney block 8 of the preferred embodiment is made of concrete, but it also can be made from another suitable hardenable construction materials such as plastic or clay. In the preferred embodiment, the chimney block is made of concrete having a compression load rating of at least 6,000 p.s.i. Chimney block 8 is of unitary construction and contains four side walls 10 formed continuously into a rectangular ring. Side walls 10 have an upper surface 14 and a lower surface 16. Chimney block 8 has a top 13 and a bottom 15 which are open, and a center 18 which is hollow.

Typically, hollow center 18 of chimney block 8 is constructed to accommodate two standard flue sizes: eight inches by eight inches and eight inches by twelve inches, but chimney block 8 of the present invention may be made any size. The thickness of the side walls 10 of the chimney block 8 is generally between two and three inches. The side walls 10 are therefore thinner than a standard brick, which allows for a standard sized brick appearance on the outside, while easily accommodating various flue sizes within the hollow center 18. This also results in a lighter chimney block for easier handling and installation. In the preferred embodiment, the side walls 10 are generally two and one-half inches thick. Chimney block 8 may also be made a variety of heights.

Side walls 10 have exterior surfaces 12 which have a simulated brick pattern 20 in the preferred embodiment. Simulated brick pattern 20 is cast onto exterior surfaces 12 when chimney block 8 is formed. The preferred embodiment shows simulated brick pattern 20 wherein the simulated bricks are shown as being laid horizontally. Other simulated brick patterns may be used including patterns wherein the simulated bricks are shown as being laid vertically. Chimney block 8 is colored to a brick red shade in the preferred embodiment, but may also be colored to other desired shades or left uncolored. The desired shade for the chimney block 8 is mixed into the construction material before it hardens within the mold. This results in the color being uniform throughout the chimney block 8, which preserves the brick or other pattern appearance in situations where small pieces of the blocks may chip or break off during transportation and installation. Instead of a gray concrete color being uncovered by the chip, the desired shade remains visible, leaving a uniform appearance to the chimney block 8.

Figure 2:
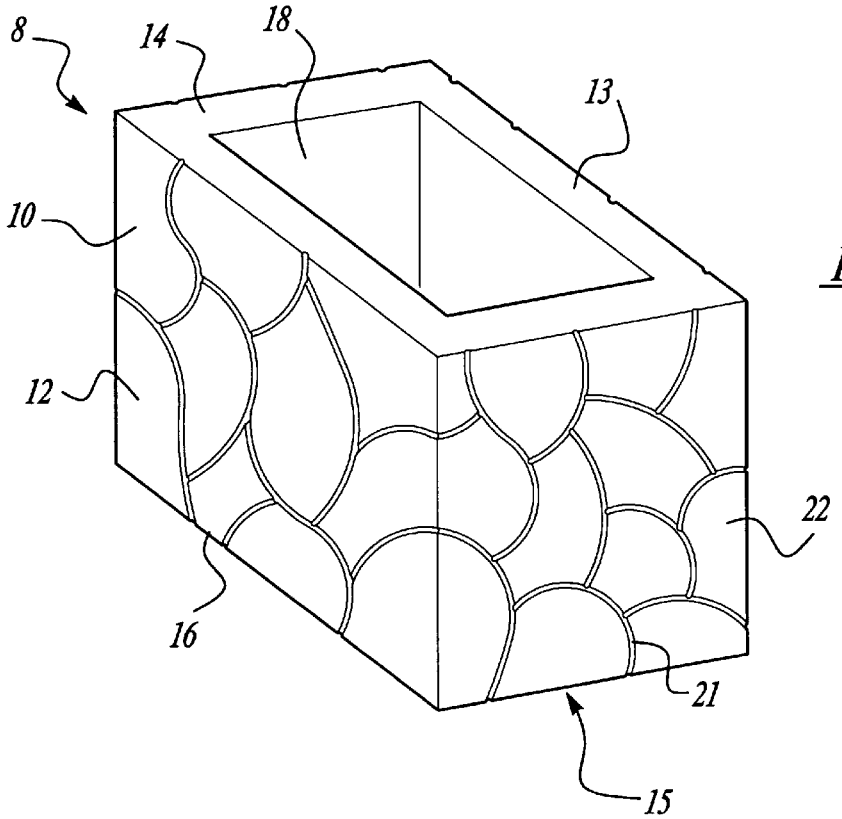
FIG. 2 is a perspective view of the chimney block of the present invention containing a simulated stone pattern on its side walls.

Chimney block 8 containing a simulated stone pattern 22 is shown in FIG. 2. Chimney block 8 with simulated stone pattern 22 is constructed in the same manner as chimney block 8 with simulated brick pattern 20.

Chimney block 8 is constructed by using a mold (not shown). The mold contains a plurality of cavities separated by projections. The mold in the preferred embodiment contains simulated brick pattern 20, but may contain other patterns including simulated stone pattern 22, or a stucco pattern, which simulate a chimney made of individual units. For the purposes of this invention, units are defined as workpieces such as bricks, stones or tiles, of which a plurality are used to construct chimneys.

In the preferred embodiment, concrete, molten plastic, clay or another appropriate hardenable construction material is poured into the mold, and simulated brick pattern 20 is cast onto exterior surfaces 12 as the material hardens. After the material hardens the mold can be removed. As noted above, the material can be colored brick red or another appropriate color before it is poured into the mold by dying or another similar process.

The projections on the mold create grooves 21 on chimney block 8. Grooves 21 are configured to be deep enough to hold a filling material 23, such as mortar, usually colored white or gray, to help set off and distinguish simulated brick pattern 20. In general, the grooves 21 are between one-half and three-quarters of an inch deep and between three-eighths and three-quarters of an inch wide. In the preferred embodiment, grooves 21 are five-eighths of an inch deep and one-half of an inch wide. Grooves 21 are filled with the mortar or other filling material after the concrete hardens and the mold is removed, creating a bi-color simulated brick pattern 20 on finished chimney block 8. Utilizing two colors to finish chimney block 8 further causes simulated brick pattern 20 to resemble a traditional brick chimney made of individual brick units.

Chimney block 8 is much more economical than a traditional brick chimney made of individual brick units, as difficult steps including tuck pointing are not required to complete chimney block 8. Chimney block 8 is pre-cast with few assembly steps and chimney block 8 consists of minimal parts. As little assembly time is required on building rooftops, worker safety is also promoted by using chimney block 8. Other chimney blocks 8 containing other decorative patterns, such as simulated stone pattern 22 or a stucco pattern, are also constructed from a single piece design in the same economical manner.

Figure 3:
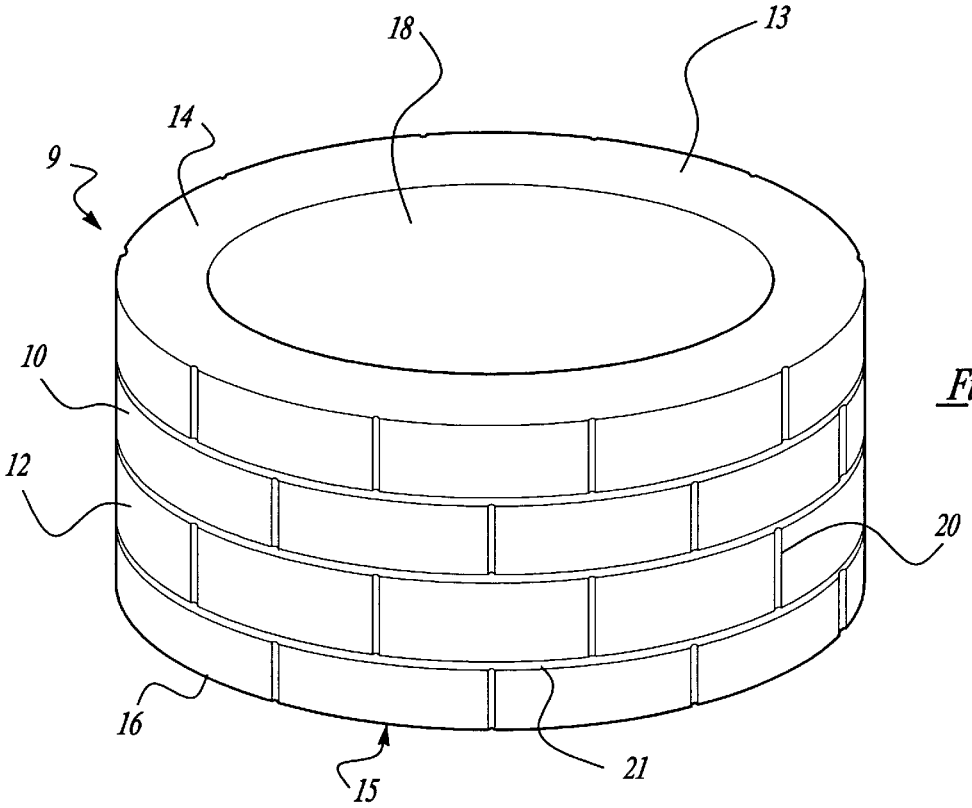
FIG. 3 is a perspective view of an oval chimney block of the present invention.
Figure 4:
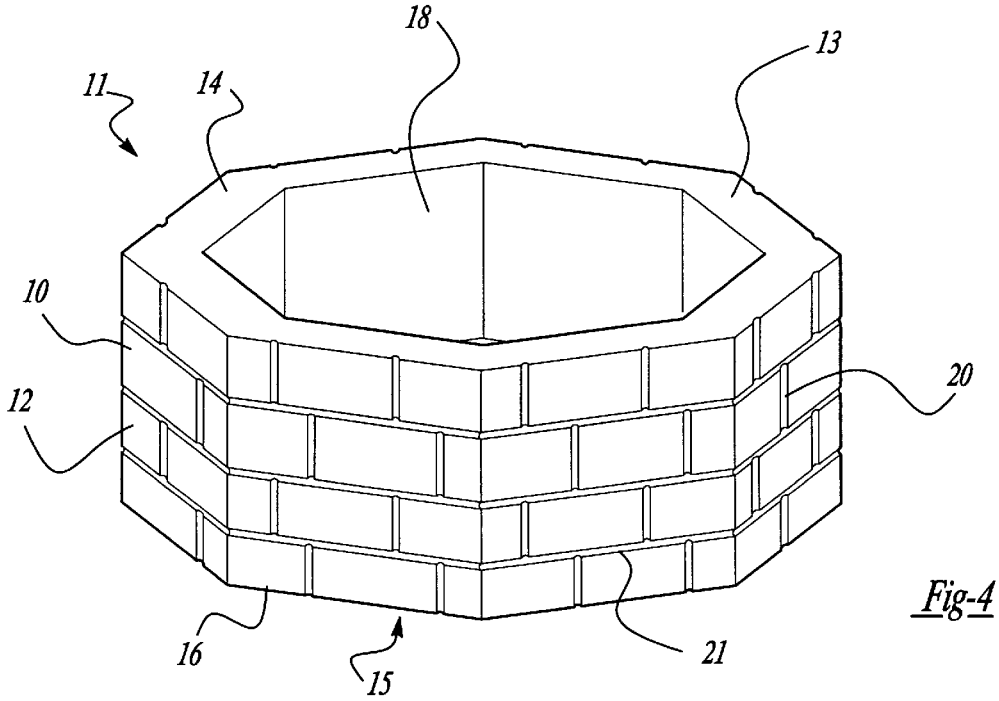
FIG. 4 is a top perspective view of an octagonal chimney block of the present invention.

While this embodiment shows a rectangular chimney block, chimney block 8 may be formed in other shapes. FIG. 3 shows an oval chimney block 9. Oval chimney block 9 is comprised of a single side wall 10 formed continuously to create an oval ring. FIG. 4 shows an octagonal chimney block 11. Octagonal chimney block 11 is comprised of eight side walls 10 formed continuously to create an octagonal ring. Chimney block 8 of the present invention is not limited to the rectangular, oval and octagonal shapes shown and may be comprised of various numbers of side walls 10 producing additional different shaped chimney blocks 8.

Chimney block 8 of the present invention may be used alone, or with one or more similar chimney blocks which may be stacked upon chimney block 8 to form a pillar. Filling or joining material, such as mortar, can be placed between the stacked chimney blocks to secure the blocks together. Furthermore, simulated brick pattern 20 or simulated stone pattern 22 can be configured such that the patterns of the stacked blocks match each other giving a continuous appearance.

Figure 5:
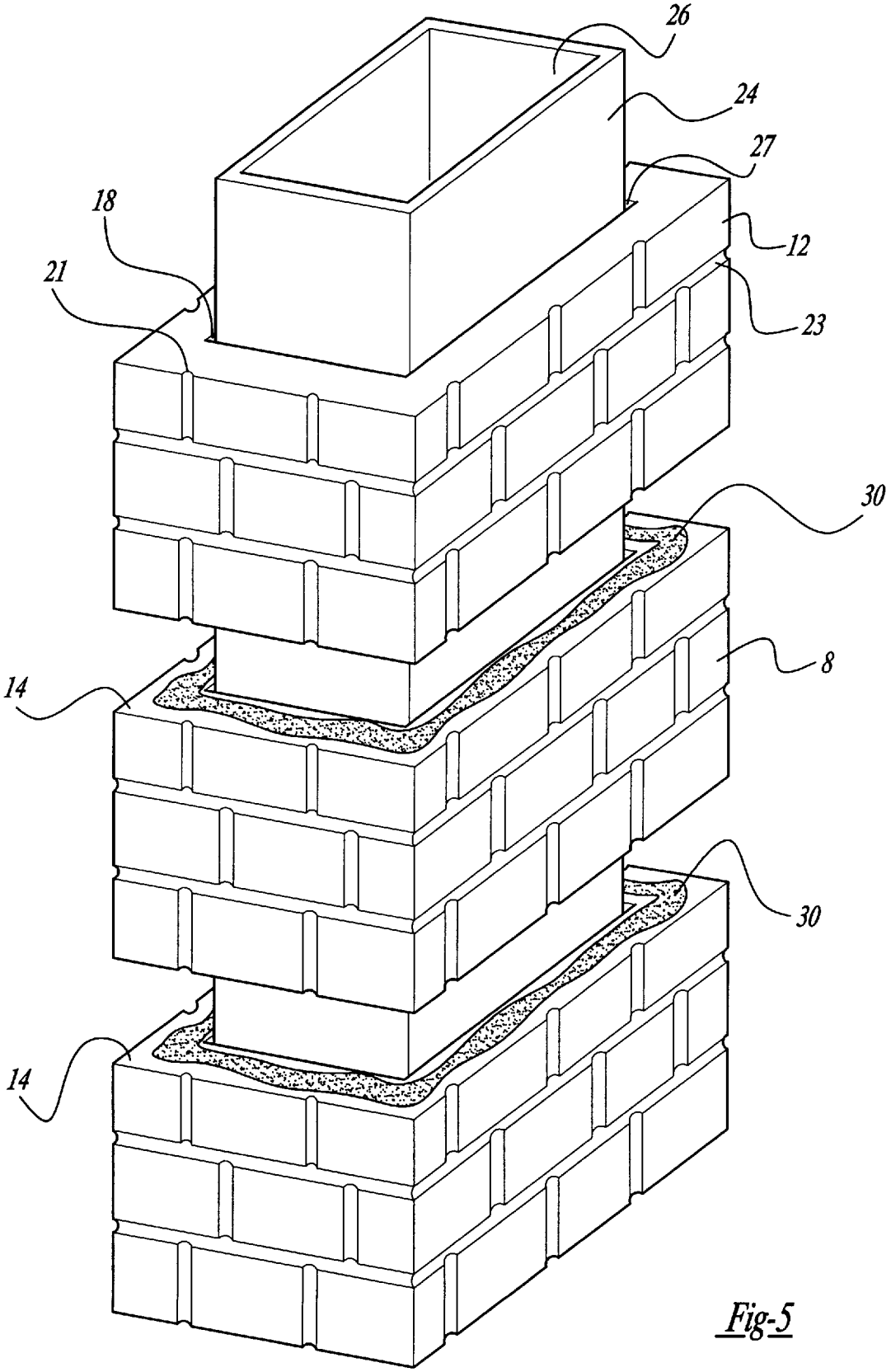
FIG. 5 is an expanded view of a chimney structure of the present invention.

Referring now to FIG. 5, an expanded view of several chimney blocks 8 stacked atop one another is shown with a flue liner 24 installed within the hollow center 18 of the blocks 8. The flue liner 24 is typically made of a clay material, and is situated over a fireplace or other burn chamber 25 to provide a continuous and smooth passageway 26 for any soot and smoke generated by the burn chamber 25. However, it is clearly within the scope of the present invention to include a flue liner made of cement or other material that is capable of withstanding the heat while also preventing accumulation of soot and debris within the passageway. It is also within the scope of the present invention to construct a chimney without any flue liner, so long as an appropriate material is used to create the chimney blocks and the interior passageway 27 is made generally smooth to avoid accumulation of soot and debris.

Figure 6:
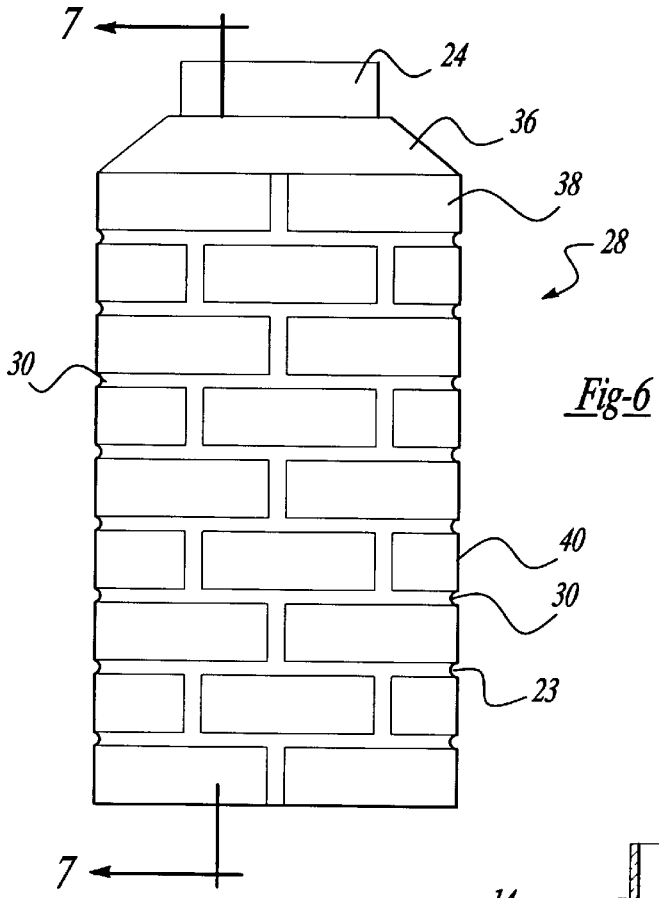
FIG. 6 is a side view of a completed chimney.
Figure 7:
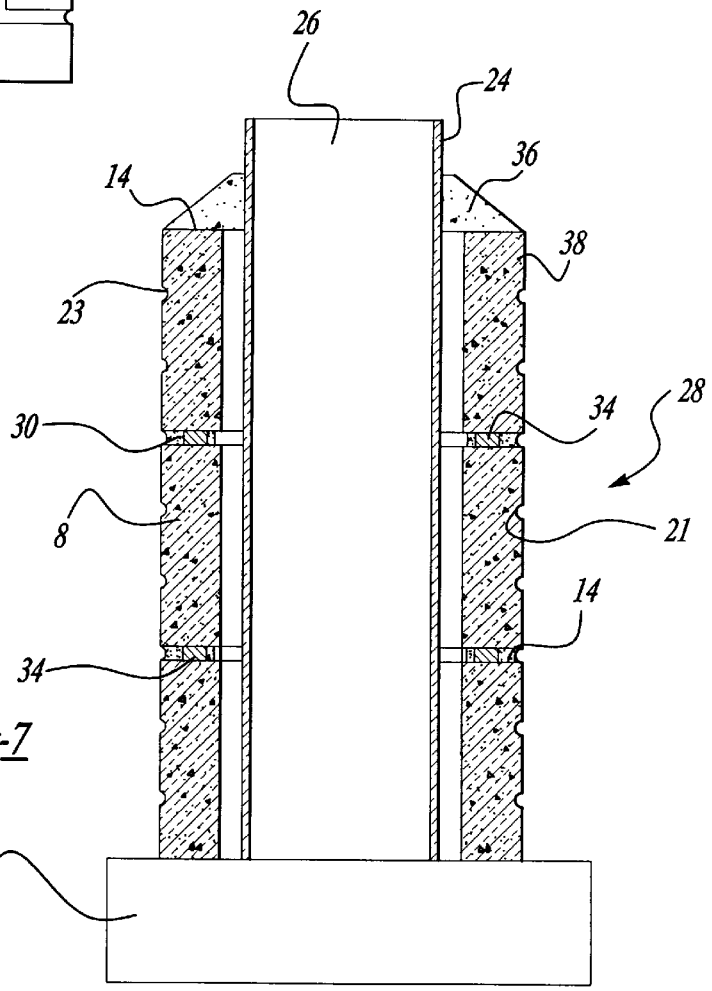
FIG. 7 is a cross-sectional view of the completed chimney taken generally along the line 7—7.

The completed chimney structure 28 is made by stacking the chimney blocks 8 atop one another. A chimney block 8 is installed on top of another block by first applying a layer of joining material, such as mortar, 30 on the upper surface 14 of the lower block. The mortar 30 is generally the same, at least in appearance, as the filling material 23 used to fill the grooves 21 on the exterior surfaces 12 of the individual chimney blocks 8. The upper block is then set in place on the mortar joint 30, which then hardens to secure the blocks 8 together. This process is repeated for each additional chimney block 8 that is added to the structure 28. Spacers 34, as shown in FIG. 7, may also be placed between the blocks 8 to ensure a uniform spacing that matches the width of the grooves 21 in the block surfaces 12. If the chimney is constructed without a flue liner, as discussed above, the inner passageway 27 through the chimney blocks 8 can be made substantially uniform and continuous by applying enough mortar between the chimney blocks so that excess mortar extends into the inner passageway 27 and then scraping off such excess mortar. Finally, as shown in FIG. 6, a cement wash cap 36, or other covering for the top of the chimney 28, may be applied to the top surface 14 of the uppermost chimney block 38 to seal the completed chimney 28 against moisture. The wash cap 36 is applied to the present invention in the same manner as it would to a typical brick or stone chimney.

The construction process for the chimney of the present invention is much easier and less expensive than the construction of a standard chimney. This is because, with the present invention, only the mortar 30 between the chimney blocks 8 and the wash cap 36 have to be applied at the construction site. Furthermore, the unitary construction of the chimney blocks 8 greatly eases the construction process of making a chimney 28. The present invention requires only minimal skills to set the chimney block 8 in place and, in the case of a chimney requiring more than one block stacked upon another, to join the two or more blocks together. None of these steps require careful positioning of each brick, tuck pointing between each brick and other difficult and/or tedious processes that are included in the construction of a standard chimney, and which require the skills of a professional mason. The application of the filler 23 to the grooves 21 does not require such processes, as it is for aesthetic purposes, and does not actually support the individual bricks and hold them together. The finished product can thus be completed much easier and more efficiently than a standard chimney.

As best shown in FIG. 6, the exterior surface 40 of the completed chimney 28 has a uniform appearance. The mortar 30 is tuck pointed between each pair of blocks at generally the same depth as the filling material 23 is pressed into the grooves 21. Therefore, upon completion of the chimney structure 28, it will be difficult for an ordinary observer to determine which groove is on the exterior surface 12 of the blocks 8 and which groove is the mortar 30 between two blocks 8. The end result is a completed chimney structure that looks and functions in the same manner as a standard brick or stone constructed chimney yet requires less skilled manual labor to build than a typical brick or stone chimney.

It is to be understood that the invention is not limited to the exact construction illustrated and described above, but that various changes and modifications may be made without departing from the spirit and scope of the invention as defined in the following claims.

I claim:

1. A combination burn chamber and chimney, comprising:

a burn chamber suitable for supporting burning matter therein;

a chimney formed from a plurality of stacked chimney blocks connected to and stacked on said burn chamber, each said chimney block being of unitary construction and made of a hardenable construction material, said construction material dyed a desired shade such that said chimney block is of uniform color throughout, said chimney block including a top, a bottom, and a center, said chimney block being open on said top and said bottom and hollow in said center, said hollow center constructed to accommodate a flue liner, said chimney block further including one or more side walls, said side walls being continuously formed and having exterior surfaces, said chimney block cast such that said exterior surfaces contain grooves which form an exterior pattern of individual overlaying bricks, a hardenable filling material inserted into said grooves in said exterior surface to give the appearance that said chimney block comprises several individual overlayed bricks held together by said filling material,;

a flue liner extending through said hollow center of each said chimney block and connected with an opening in said burn chamber, said flue liner providing a smooth continuous passageway for soot and smoke generated by the burn chamber; and a layer of joining material between adjacent chimney blocks, said joining material located between said chimney blocks and holding said stacked chimney blocks in place, said joining material being substantially similar in appearance to said filling material.

2. The combination burn chamber and chimney of claim 1 further comprising a plurality of spacers positioned intermittently around said top of said chimney blocks, said spacers providing a uniform gap between said chimney blocks such that said grooves on said exterior surface of said chimney blocks and said gap are substantially the same.

3. The combination burn chamber and chimney of claim 1 wherein said chimney block includes four said side walls, said chimney block being a rectangular ring.

4. The combination burn chamber and chimney of claim 1 wherein said chimney block includes a single said side wall, and said chimney block being an oval ring.

5. The combination burn chamber and chimney of claim 1 wherein said chimney block includes eight said side walls, and said chimney block being an octagonal ring.

6. A combination burn chamber and chimney, comprising:

a burn chamber suitable for supporting burning matter therein;

a chimney formed from a plurality of stacked chimney blocks connected to and stacked on said burn chamber, each said chimney block being of unitary construction and made of a hardenable construction material, said construction material dyed a desired shade such that said chimney block is of uniform color throughout, said chimney block including a top, a bottom, and a center, said chimney block being open on said top and said bottom and hollow in said center, said hollow center constructed to accommodate a flue liner, said chimney block further including one or more side walls, said side walls being continuously formed and having exterior surfaces, said chimney block cast such that said exterior surfaces contain grooves which form an exterior pattern of individual overlaying stones, a hardenable filling material inserted into said grooves in said exterior surface to give the appearance that said chimney block comprises several individual overlayed stones held together by said filling material;

a flue liner extending through said hollow center of each said chimney block and connected with an opening in said burn chamber, said flue liner providing a smooth continuous passageway for soot and smoke generated by the burn chamber; and a layer of joining material between adjacent chimney blocks, said joining material located between said chimney blocks and holding said stacked chimney blocks in place, said joining material being substantially similar in appearance to said filling material.

* * * * *